US006148971A

United States Patent [19]

Kho

[11] Patent Number: 6,148,971

[45] Date of Patent: Nov. 21, 2000

[54] EASILY PULLABLE SUITCASE

[76] Inventor: Dick T Kho, P.O. Box 344 54, West Los Angeles, Calif. 90034

[21] Appl. No.: 09/426,316

[22] Filed: Oct. 25, 1999

Related U.S. Application Data

[63] Continuation-in-part of application No. 09/294,880, Apr. 20, 1999, abandoned.

[60] Provisional application No. 60/117,168, Jan. 25, 1999.

[51] Int. Cl.[7] ..... A45C 5/14; A45C 13/26; A45C 13/36

[52] U.S. Cl. ..... 190/18 A; 190/39; 190/115; 190/127

[58] Field of Search ..... 190/18 A, 39, 190/115, 122, 127; 280/37

[56] References Cited

U.S. PATENT DOCUMENTS

| | | | |
|---|---|---|---|
| 362,868 | 5/1887 | Roberts | 190/18 A X |
| 832,628 | 10/1906 | Schreffler | 190/18 A X |
| 1,014,475 | 1/1912 | Holloway | 190/18 A X |
| 4,066,156 | 1/1978 | Basile | 190/18 A X |
| 5,114,164 | 5/1992 | Bothwell et al. | 190/18 A X |
| 5,197,579 | 3/1993 | Bieber et al. | 190/18 A |
| 5,330,037 | 7/1994 | Wang | 190/18 A |
| 5,431,263 | 7/1995 | Nordstrom | 190/18 A |
| 5,489,107 | 2/1996 | Kho | 190/18 A X |
| 5,529,156 | 6/1996 | Yang | 190/18 A X |
| 5,542,510 | 8/1996 | Rekuc et al. | 190/18 A |
| 5,588,569 | 12/1996 | Mitomi et al. | 190/18 A X |
| 5,630,521 | 5/1997 | Waddell et al. | 190/18 A |

FOREIGN PATENT DOCUMENTS

| | | | |
|---|---|---|---|
| 487220 | 11/1953 | Italy | 190/18 A |

*Primary Examiner*—Sue A. Weaver
*Attorney, Agent, or Firm*—Monty Koslover

[57] ABSTRACT

An easily pullable suitcase which can be towed on all four wheels or on two main wheels with comfort using an attached pulling handle. The handle can be free pivoting to pull the suitcase on four wheels, or can be rigidly fixed in a position that eases lifting the suitcase front end and pulling the suitcase on the two main wheels. The two main wheels are located with their axle under the suitcase center of gravity so that, when pulled on the main wheels, the suitcase weight is carried by the wheels, causing minimum pressure on the hand of a pulling person. The bottom of the suitcase is V-shaped to allow clearance for the bottom rear end when the front end of the suitcase is lifted upwards and pulled on two main wheels.

8 Claims, 6 Drawing Sheets

EASILY PULLABLE SUITCASE

This is a Continuation-In-Part of application Ser. No. 09/294,880 filed Apr. 20, 1999, now abandoned. Provisional 60,117,168 filed Jan. 25, 1999.

BACKGROUND OF THE INVENTION

1. Field of the Invention

This invention relates to luggage and in particular to suitcases having attached wheels and a handle for pulling.

2. Background

The prior art includes many suitcases having castered wheels that are mounted on the suitcase bottom wall and which also include a handle for pulling the suitcase along on the wheels. The handles may be rigid or flexible, and are often built into the luggage for convenience. When the suitcase is being pulled with all four castered wheels over a relatively smooth surface, this arrangement works reasonably well, but still imposes considerable strain on a user's pulling hand and arm, particularly over a partly uneven stretch of ground or around a corner. As seasoned travelers are well aware, a suitcase tends to tip over sometimes on an uneven straight surface and when turning corners, and has to be lifted on its rear wheels in order to negotiate a corner. Some presently available suitcases have two main wheels located at about the center of the suitcase bottom, in addition to castered wheels at the suitcase ends. This arrangement allows the suitcase to be partly tilted upward at its front end and pulled on its main wheels and rear casters, making it easier to pull without tipping. However, the suitcase can not have its front end tilted enough to avoid tipping while going around corners, because its rear bottom end touches the floor. Also, unless the pulling handle is fixed rigidly, there will remain appreciable extra strain on a user pulling arm when pulling on the two main wheels.

There is thus a need for a towable suitcase that can be pulled with comfort and without undue strain on the hand, over flat or uneven surfaces and around corners.

SUMMARY OF THE INVENTION

The invention is a suitcase that can be towed, using an attached pivoted pulling handle, on four wheels or on two main wheels. Provision is made for the pulling handle to be fixed rigidly at a small upward angle for towing on the two main wheels, and the two main wheels are located with the suitcase center of gravity over the axle or transverse axis of the main wheels, causing a minimum of pressure on the hand of the person towing the suitcase. To enable the suitcase to be pulled easily on either four wheels or on the two main wheels, the bottom of the suitcase is V-shaped, permitting adequate ground clearance for the back end of the case when the front end of the suitcase tilts up when towed on its two main wheels. As an option, provision is made for releasably retaining a large wheel-axle assembly which is provided for attachment to the suitcase bottom as being useful for pulling the suitcase over uneven ground.

Accordingly, it is a prime object of the present invention to provide a suitcase that can be pulled easily without undue strain on the hand and arm of a user over flat or uneven ground.

An advantage of the invention over presently available towable suitcases is its adaptability to hard-sided suitcases and to soft sided suitcases.

Another advantage is its relatively low cost.

Further objects and advantages of the invention will be apparent from studying the following portion of the specification, the claims and the attached drawings.

DESCRIPTION OF THE PREFERRED EMBODIMENT

Figure 1:
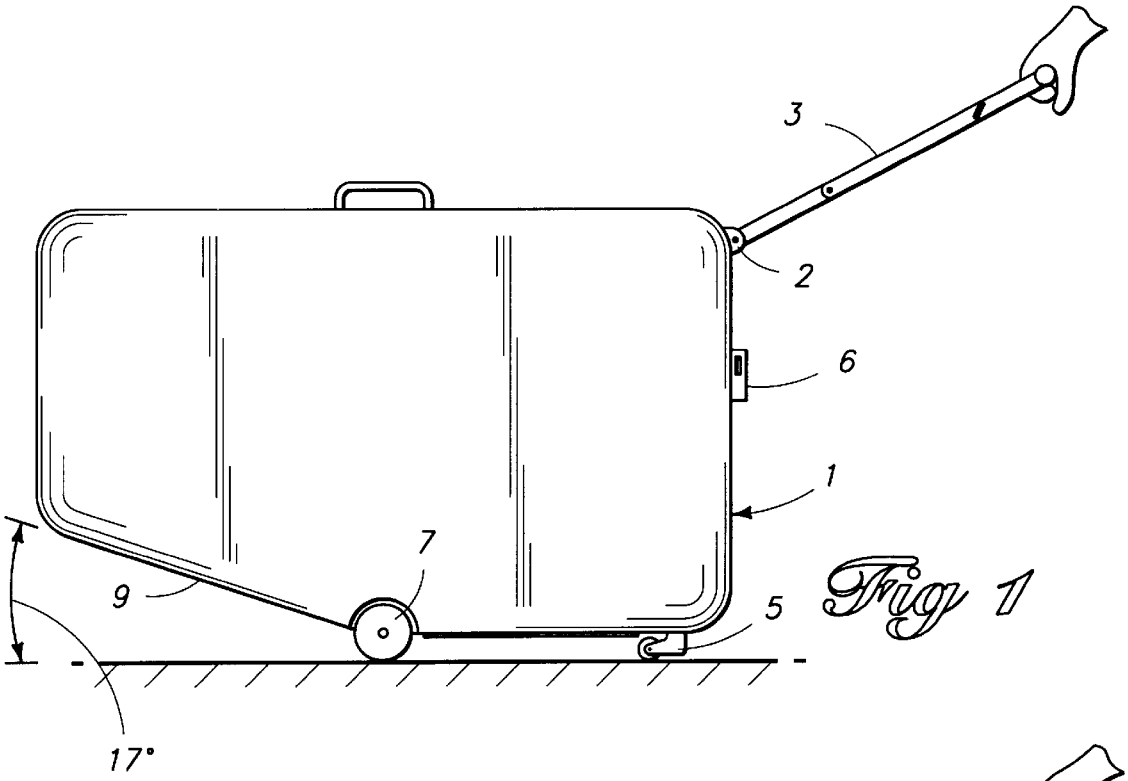
FIG. 1 is a side elevation view of a hard-sided suitcase according to the present invention being pulled using all its' wheels, particularly showing how the suitcase rear bottom portion is angled to allow for tilting.
Figure 2:
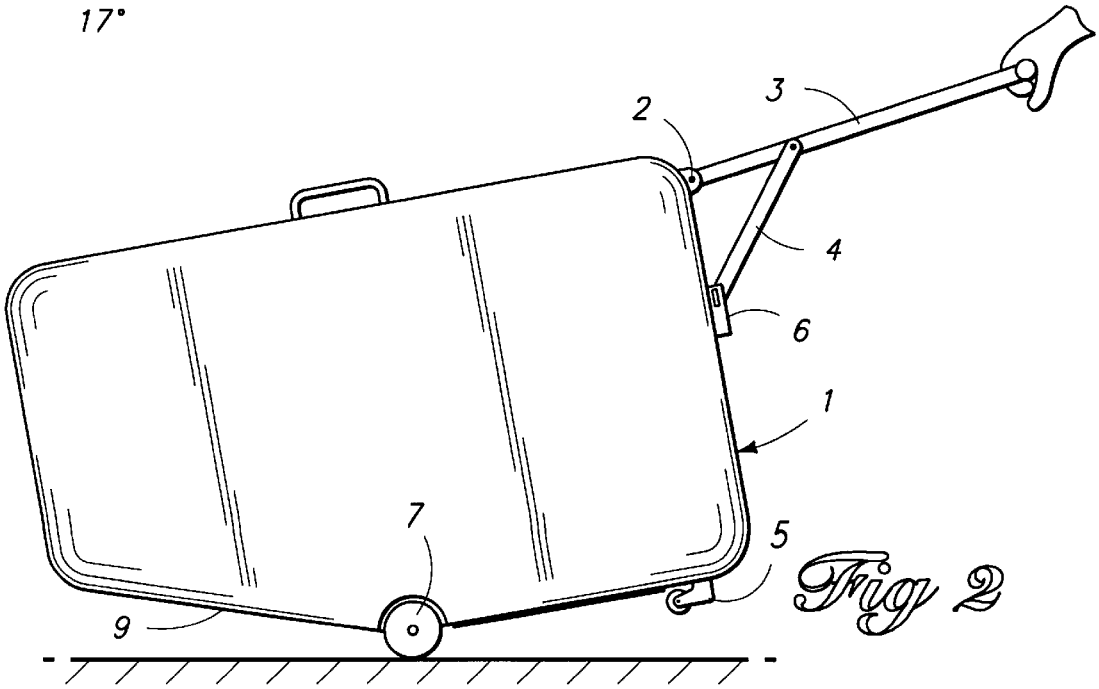
FIG. 2 is a side elevation view of the invention hard-sided suitcase being pulled with its' front portion up at an angle, particularly showing the pulling handle fixed rigidly and the suitcase rear bottom portion having good ground clearance.

Referring particularly to FIGS. 1 and 2, there are shown two side views of a hard-sided suitcase 1 according to the present invention, being pulled over a reasonably flat surface such as exists in airport lobbies and halls. The suitcase 1 has two sets of wheels fastened to its bottom portion. These are two main wheels 7, one on each side, which are located at the approximate center of gravity of the suitcase 1, and a pair of casters 5 that are located near to the suitcase front end. A pulling handle 3 is fastened by a pivot pin to an attachment member 2 fixed near to the top of the suitcase 1, at the front end. As shown in FIG. 2, the pulling handle 3 may also be braced and made rigid by a strut assembly 4 that pivots on the pulling handle 3 at one end and locks in to a suitcase latching plate 6 on its distal end.

This rigid handle arrangement, when initiated by the person pulling the suitcase, greatly eases the lifting strain caused by holding up one end of the suitcase. The main wheels 7 are located near the suitcase center of gravity in order to carry most of the load when the suitcase front end is lifted as shown in FIG. 2.

The bottom surface of the suitcase 1, from its approximate center at the main wheels 7 to the rear end of the suitcase, is angled upward 9 at an angle of about 17 degrees. This angle has been found to correlate with the expected pulling angle made by the suitcase handle when pulled by an adult as in FIG. 2, and allows a good ground clearance for the rear portion of the suitcase.

Airport terminal halls usually include a number of turns that will cause the conventional, three or four wheeled suitcase to tip sideways as every experienced air traveler will attest. However, when the angled bottom suitcase described herein is pulled as shown in FIG. 2, there is no demonstrated tendency to tip sideways. This is due to the central location of the main wheels 7 which act as a stable turning support when the front end of the suitcase 1 is rigidly lifted and pulled upward sufficiently.

Figure 3:
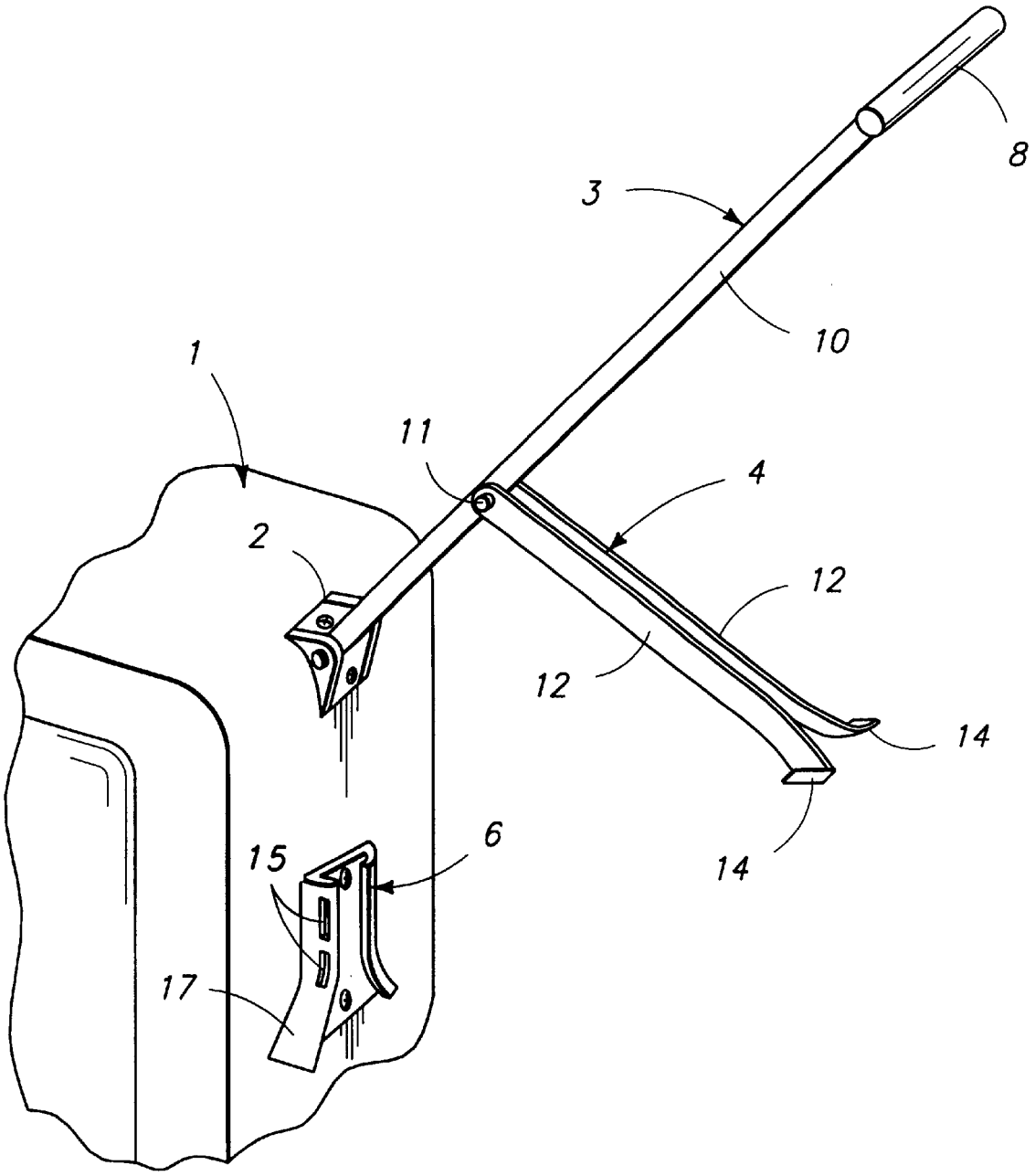
FIG. 3 is a partial perspective view of the front end of the invention suitcase, particularly showing detail of the pulling handle assembly, and a latch plate attached to the suitcase below the handle that serves both to hold the handle rigid and to store it.
Figure 4:
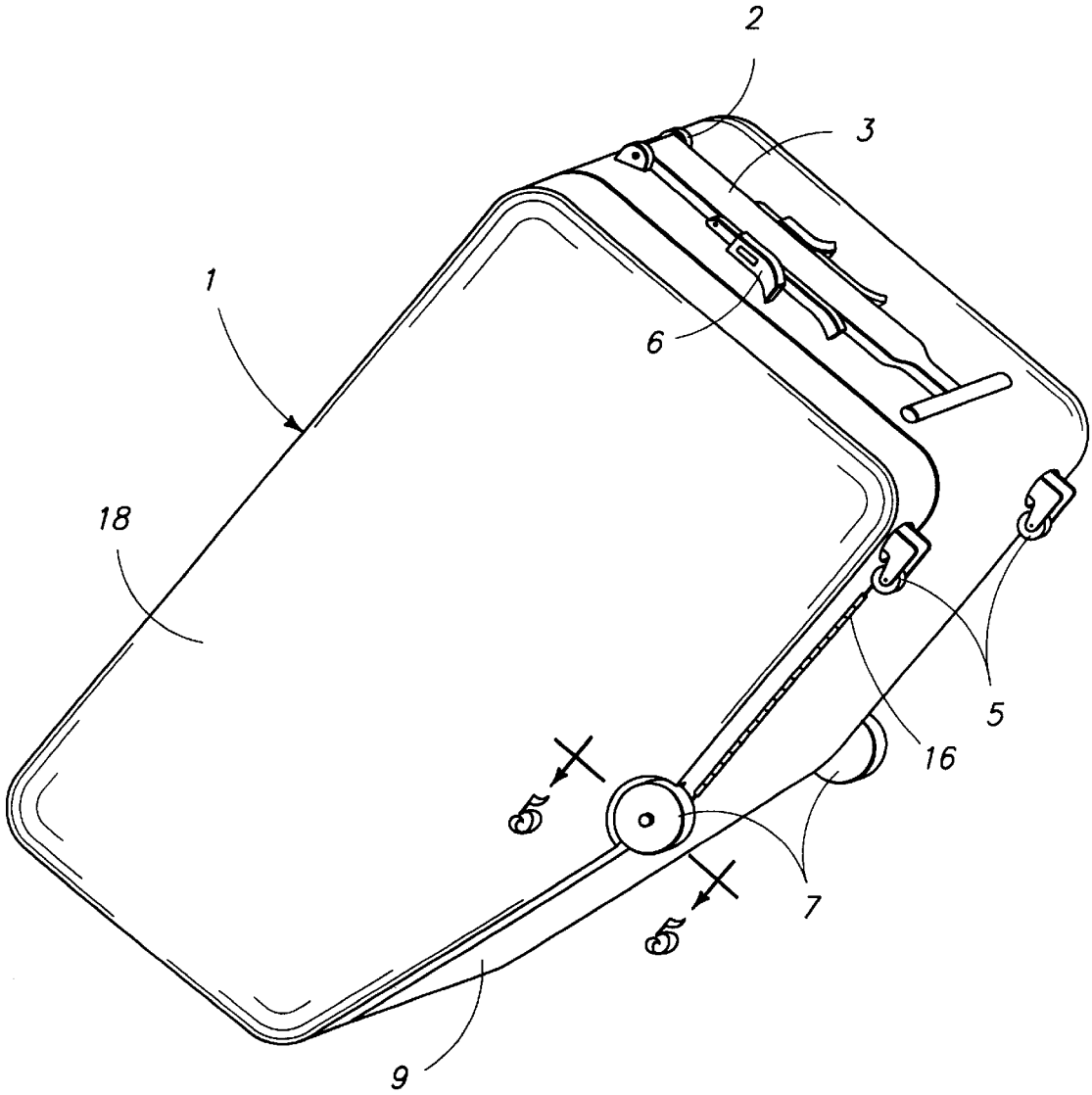
FIG. 4 is a bottom perspective view of a hard-sided suitcase according to the present invention, particularly showing the location of the cover hinge on the suitcase bottom surface and the pulling handle in the stored position.

Refer now to FIGS. 3 and 4 which show details of the pulling handle 3 construction and a bottom perspective view of a hard-sided suitcase according to the present invention.

The pulling handle 3 is an assembly of a handle grip 8, a long and rigid metal rod 10 to which the grip 8 is attached, and a strut assembly 4 that pivots on the rod 10 at about two thirds of the rod length down from the grip 8 end on a first pivot pin 11.

A second pivot pin connects the rod 10 distal end to the suitcase attachment member 2. The strut assembly 4 comprises two identical plate strips 12 made of springy material. At the free end of each plate strip 12 is a portion that is bent partially backward at an acute angle. These bent portions serve as lips 14 that can engage the latching plate 6 which is on the suitcase end below the handle.

The latching plate 6 and the strut assembly 4 provide the means for holding the pulling handle 3 rigidly to the suitcase shown in FIG. 2. As shown in FIG. 4, the latching plate 6 also provides means for gripping and storing the pulling handle 3 flat against the end of the suitcase 1 when the pulling handle is not being used. It therefore serves double functions which are that of latching and storing.

As shown in FIG. 3, the latching plate 6 is a metal member that is formed having a center flat portion and two longitudinal side portions that protrude outward away from the suitcase at an acute angle. Both side portions are curved away at their bottom ends 17 to present a flared opening sized in width to permit the lip 14 ends of the strut assembly 4 plates 12 to enter the opening. These lip ends 14 will then snap into slots 15 located on both side portions of the latching plate 6 and secure the strut assembly 4, thus holding the pulling handle 3 rigid with respect to the suitcase.

While the rod 10 and the latching plate 6 are described above as being made of metal, all parts of the handle system could be made from metal, plastic or even composite material.

Referring again to FIG. 4, it should be noted that the hinge 16 on which the suitcase lid 18 turns to open or close, is located on the forward half of the suitcase bottom only. The rearward half of the suitcase lid 18 may be secured to the suitcase bottom with easy entry clips on the inside of the case and lid 18, allowing the lid 18 to be opened and closed.

Figure 5:
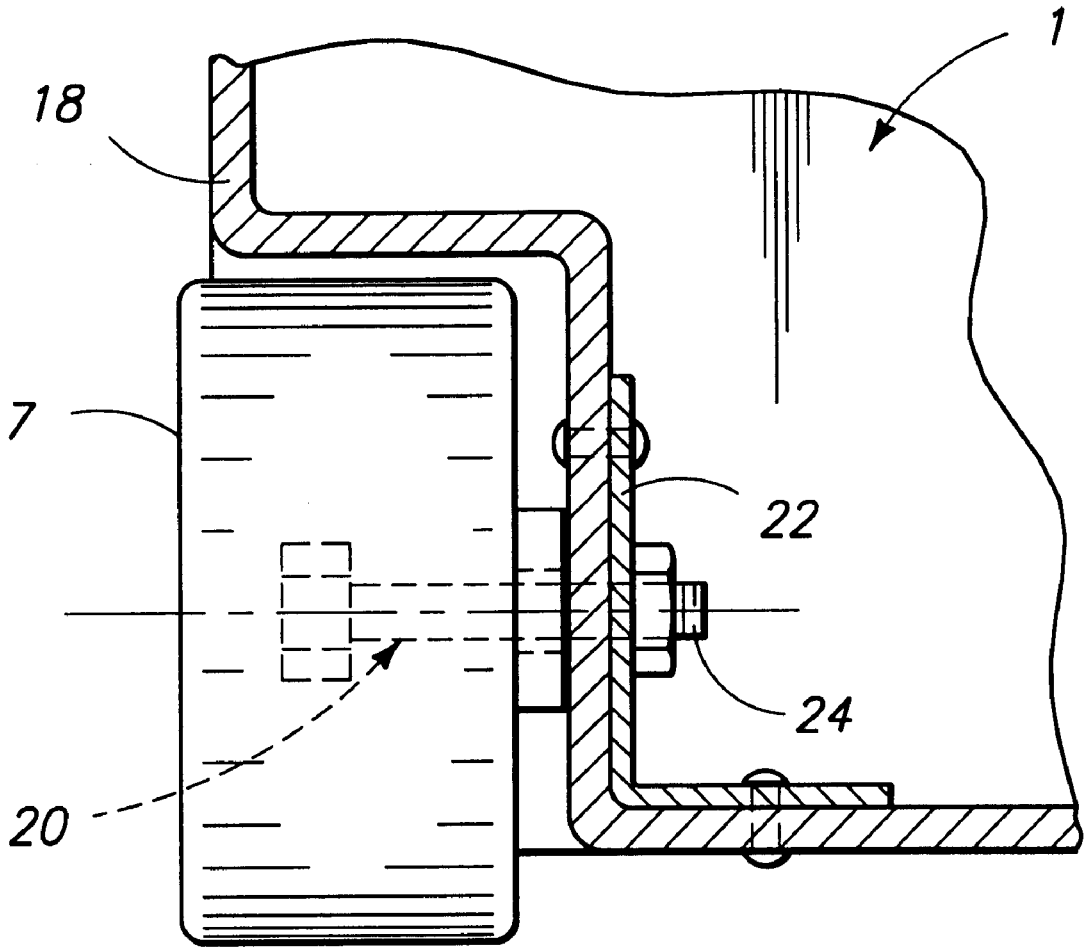
FIG. 5 is a cross-section view taken along line 5—5 of FIG. 4, showing how the main wheels are fastened to the suitcase of the present invention.

FIG. 5 is a cross-section view taken along line 5—5 of FIG. 4, showing how the main wheels are fastened to the hard-sided suitcase 1. The main wheels 7 attachment in this case, poses a problem in that the wheels need to be separately attached without an axle between them, to allow the lid 18 to open and close. The solution to the wheel fastening arrangement shown in FIG. 5 is not new, similar methods having been used often in available suitcases by this inventor and others. For this reason of demonstrated practicality, the approach is selected. A main wheel 7 is fastened by a bolt 20 through the center of its hub to a wheel inset portion of the suitcase lid 18 and to an inset portion of the distal side of the suitcase. The bolt threaded end 24 is tightened by a locknut against a metal L piece 22 that is fastened to the suitcase inner wall as a stiffener. The wheel 7 includes ball bearings and may then rotate easily around the fixed bolt.

Figure 6:
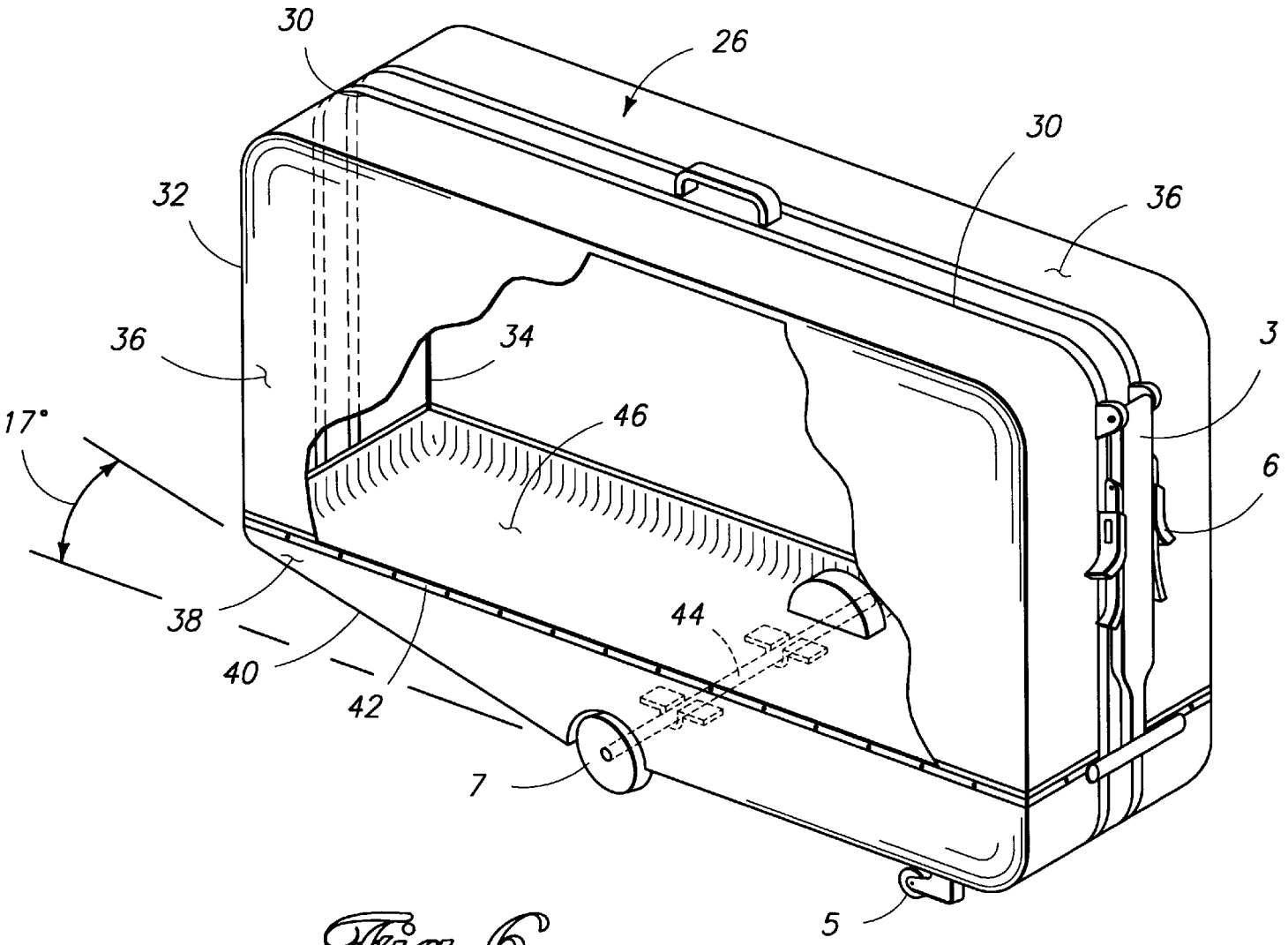
FIG. 6 is a partially cutaway perspective view of a soft-sided suitcase according to the present invention.

Another suitcase embodiment of the present invention is that of a soft-sided suitcase 26 which is illustrated in FIG. 6. This illustration is a perspective view of a soft-sided suitcase 26, with the suitcase lid face partially cut away to show the suitcase inside surfaces.

Many aspects of the soft-sided suitcase 26 are identical to those described earlier for the hard-sided suitcase 1. These aspects include the pulling handle 3, latch plate 6 and the method by which the pulling handle 3 is held rigidly to the suitcase. It includes the slope of the rearward portion 40 of the suitcase bottom surface, which is about 17 degrees, and also the placement of the pairs of front casters 5 and the main wheels 7.

The main wheels 7 may be fastened to the soft-sided suitcase 26 in the manner shown for the hard-sided suitcase, or alternately, they may be joined by an axle 44 which is attached under the suitcase as indicated in FIG. 6 or across the inside bottom of the suitcase.

The suitcase body is made using upper panels 36 that are made of cloth which are supported by a frame 30, 32, 34, and a molded, tray-like member that serves as a carrier lower container 38, and is hard sided with a hard bottom wall 46. The lower container 38 is attached to and provides support for the frame 30, 32, 34, and the soft-sided panels 36. In this configuration, the suitcase lid is hinged 42 to one side of the lower container 38, permitting comfortable opening when needed. This configuration suitcase has the same pulling and maneuvering attributes as does the hard-sided suitcase described above.

Both types of suitcases, soft and hard-sided, are very easy to pull, particularly on the main wheels alone. However, pulling over uneven surfaces such as found in parking lots, can present some difficulty. This difficulty may be avoided by attaching retainer brackets to the bottom of the suitcase for holding and retaining a large wheel assembly which is provided for pulling over uneven surfaces.

Figure 7:
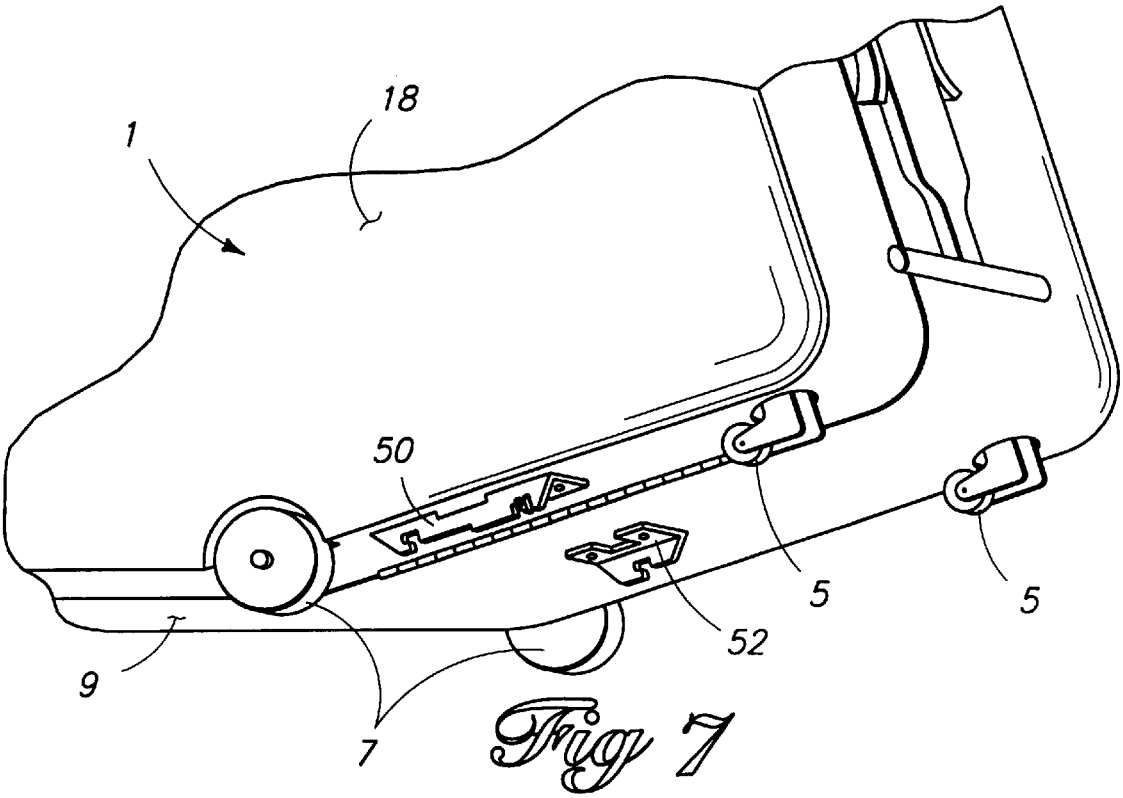
FIG. 7 is a partial perspective view of the bottom of the invention suitcase, particularly showing two retainer brackets attached to the suitcase bottom for the purpose of mounting a large wheel axle assembly.

The retainer brackets 50 and 52 and their attachment location on the suitcase bottom surface is shown in FIG. 7, which shows a partial perspective view of the hard-sided suitcase 1. The retainer brackets are similarly located on the bottom of the soft-sided suitcase 26.

Figure 8:
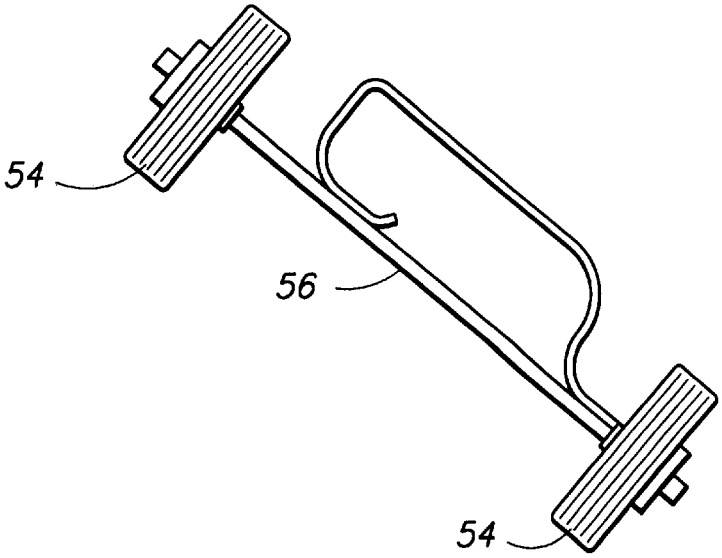
FIG. 8 is a view of a large wheel axle assembly designed to fit on the brackets shown in FIG. 7.

A large wheel assembly designed to fit and be secured to the retainer brackets 50, 52 is illustrated in FIG. 8. Both the retainer brackets and the large wheel assembly are described in U.S. Pat. No. 5,489,107 issued to the present inventor Dick T. Kho, and which is hereby incorporated herein.

For operation and pulling over uneven surfaces, the axle 56 of the large wheel assembly is placed in the slot of right bracket 52 and in the rearward slot of left bracket 50, and the wheel assembly handle turned so that the handle engages the forward slot of the left bracket 50. The large wheels 54 will then protrude over the sides of the suitcase and the wheel assembly is secured to the suitcase. The suitcase bottom will then be lifted well above any uneven ground areas and the suitcase can be easily pulled on the large wheels 54 alone, using the rigidly braced pulling handle.

From the foregoing descriptions, it is clear that the embodiments of a hard-sided suitcase and a soft-sided suitcase achieve the objects of the present invention. Various modifications may be apparent to those skilled in the art. These modifications are considered to be within the scope and spirit of the present invention and are encompassed thereby.

Having described the invention, what is claimed is:

1. A hard-sided pullable suitcase comprising:

(a) a generally rectangular shaped molded case, comprising an open container portion and a lid portion, said lid portion connected to said container portion by a hinge;

said molded case having elongate opposing parallel, planar side walls, a planar top wall and an opposing bottom wall, a planar front end wall and an opposing planar rear end wall; said bottom wall having a forward portion and a rearward portion, said forward portion extending in a horizontal plane from said front end wall to about midway between said front end wall and said rear end wall, said rearward portion—inclining upward—from said forward portion to said rear end wall at an angle of about 17 degrees to the plane defined by said forward portion;

(b) a pair of main wheels, rotatably mounted transversely to said side walls adjacent to said bottom wall at the proximate midway point corresponding to a vertical line through the suitcase center of gravity, thereby locating said main wheels for carrying most of the suitcase weight;

(c) a pair of castered wheels mounted on said bottom wall adjacent to said front end wall;

(d) a carrying handle, mounted on said top wall at its proximate center;

(e) a pulling handle, pivotably mounted on said front end wall adjacent to said top wall; and (f) means for fixing said pulling handle rigidly in place to facilitate lifting the suitcase front end and pulling said suitcase on said main wheels; said—rearward portion of said bottom wall—providing adequate ground clearance for the rear end of the case when said suitcase is pulled forward on its main wheels using a rigidly fixed pulling handle.

2. A suitcase according to claim 1, wherein:

said means for fixing said pulling handle rigidly in place includes two elongate strut members, pivotably fastened opposing each other at one end to said pulling handle, and a latch plate which is attached to the front end wall of said molded case; the distal portion and distal ends of said strut members being permanently bent outwards and springy, forming a wide opening between the sides of said strut members at their distal ends, said distal ends of said strut members each including a portion permanently bent at an acute angle outward, forming fastening lips;

said fastening lips engaging with slots in said latch plate, thereby fixing said pulling handle rigidly in place.

3. A suitcase according to claim 2, wherein:

said latch plate includes means for storing said pulling handle against the front end wall of said case; said latch plate having two side walls fixedly secured to a flat base, said base and side walls having a U-shaped cross-section, forming a cup-like structure for enclosing and gripping the sides of said pulling handle and strut members, said side walls also being flared outward near their bottom ends, providing an opening for said fastening lips of said strut members to enter when fixing said pulling handle rigidly in place.

4. A suitcase according to claim 1, further comprising:

two retainer brackets for retaining a wheel-axle assembly, and a wheel-axle assembly of two large wheels; said retainer brackets being fastened to said forward portion of said bottom wall adjacent to the transverse axis of said main wheels, said retainer brackets configured with slots permitting the retention or release of said wheel-axle assembly; said wheel-axle assembly, when secured to the bottom wall of said molded case, providing a considerable clearance between said bottom wall and uneven ground, over which said suitcase may be more easily pulled.

5. A soft-sided pullable suitcase comprising:

(a) a molded, rigid tray-like member serving as a carrier lower container; said carrier lower container having an open top, elongate opposing parallel planar side walls, a bottom wall, a planar front end wall and an opposing planar rear end wall; said bottom wall having a forward portion and a rearward portion, said forward portion extending in a horizontal plane from said front end wall to about midway between said front end wall and said rear end wall, said rearward portion—inclining upward—from said forward portion to said rear end wall at an angle of about 17 degrees to the plane defined by said forward portion;

(b) a hinge attached near the top edge of one side wall of said carrier lower container;

(c) a frame,—said frame having a first portion attached to said hinge and a second portion attached to a side wall of said carrier lower container opposing said hinge, and to said front end wall and said rear end wall; said frame providing support for a suitcase lid and soft material panels;

(d) a top panel, two opposing side panels, a front-end panel and a rear end panel, all said panels made of a soft material and fastened to said frame, forming a continuous enclosure when said suitcase lid is closed;

(e) a pair of main wheels, rotatably mounted transversely to said side walls of said carrier lower container, adjacent to said bottom wall at the proximate midway point corresponding to a vertical line through the suitcase center of gravity, thereby locating said main wheels for carrying most of the suitcase weight;

(f) a pair of castered wheels mounted on said bottom wall adjacent to said front end wall;

(g) a carrying handle, mounted on said top panel at its proximate center;

(h) a pulling handle, pivotably mounted on said front end panel adjacent to said top panel; and (i) means for fixing said pulling handle rigidly in place to facilitate lifting the suitcase front end and pulling said suitcase on said main wheels; said—rearward portion of said bottom wall—providing adequate ground clearance for the rear end of the case when said suitcase is pulled forward on its main wheels using a rigidly fixed pulling handle.

6. A suitcase according to claim 5, wherein:

said means for fixing said pulling handle rigidly in place includes two elongate strut members, pivotably fastened opposing each other at one end to said pulling handle, and a latch plate which is attached to the front end panel of said suitcase below the pivoting end of said pulling handle; the distal portion and distal ends of said strut members being permanently bent outwards and springy, forming a wide opening between the sides of said strut members at their distal ends, said distal ends of said strut members each including a portion permanently bent at an acute angle outward, forming fastening lips;

said fastening lips engaging with slots in said latch plate, thereby fixing said pulling handle rigidly in place.

7. A suitcase according to claim 6, wherein:

said latch plate includes means for storing said pulling handle against the front end panel of said suitcase; said latch plate having two side walls fixedly secured to a flat base, said base and side walls having a U-shaped cross-section, forming a cup-like structure for enclosing and gripping the sides of said pulling handle and strut members, said side walls also being flared outward near their bottom ends, providing an opening for said fastening lips of said strut members to enter when fixing said pulling handle rigidly in place.

8. A suitcase according to claim 5, further comprising two retainer brackets for retaining a wheel-axle assembly, and a wheel-axle assembly of two large wheels; said retainer brackets being fastened to said forward portion of said bottom wall adjacent to the transverse axis of said main wheels, said retainer brackets configured with slots permitting the retention or release of said wheel-axle assembly; said wheel-axle assembly, when secured to the bottom wall of said carrier lower container, providing a considerable clearance between said bottom wall and uneven ground, over which said suitcase may be more easily pulled.

* * * * *